US009199765B1

(12) United States Patent
Lekic

(10) Patent No.: US 9,199,765 B1
(45) Date of Patent: Dec. 1, 2015

(54) UNIVERSAL COASTER AND STACKING DEVICE

(71) Applicant: Adnan Lekic, New York, NY (US)

(72) Inventor: Adnan Lekic, New York, NY (US)

( * ) Notice: Subject to any disclaimer, the term of this patent is extended or adjusted under 35 U.S.C. 154(b) by 0 days.

(21) Appl. No.: 14/737,155

(22) Filed: Jun. 11, 2015

(51) Int. Cl.

| | |
|---|---|
| ***A47B 91/00*** | (2006.01) |
| ***B65D 21/02*** | (2006.01) |
| ***A47G 23/03*** | (2006.01) |
| ***A47G 35/00*** | (2006.01) |

(52) U.S. Cl.
CPC ..... *B65D 21/0224* (2013.01); *A47G 23/0316* (2013.01); *A47G 35/00* (2013.01)

(58) Field of Classification Search
CPC . B65D 21/0224; A47G 23/0316; A47G 35/00
USPC ..... 248/146, 346.01, 346.03, 346.06, 248/346.07, 346.11
See application file for complete search history.

(56) References Cited

U.S. PATENT DOCUMENTS

| | | | | | |
|---|---|---|---|---|---|
| 332,201 | A * | 12/1885 | Hurley | D06F 79/02 | 248/117.2 |
| 1,187,899 | A | 6/1916 | Gardam | | |
| 2,583,951 | A | 1/1952 | Kliegel | | |
| 3,363,869 | A * | 1/1968 | Blundell | A47G 23/03 | 215/394 |
| 3,598,271 | A | 8/1971 | Holley | | |
| 4,858,872 | A * | 8/1989 | Witt | A47G 23/03 | 248/146 |
| 4,953,823 | A * | 9/1990 | Sheaffer | A47G 23/032 | 215/394 |
| 8,087,630 | B1 * | 1/2012 | Matthews | A45F 3/44 | 248/156 |
| 2004/0238711 | A1 * | 12/2004 | Ngo | A47B 91/12 | 248/346.11 |
| 2009/0057248 | A1 | 3/2009 | Vishnevsky | | |
| 2010/0133285 | A1 | 6/2010 | Schepen et al. | | |
| 2011/0174658 | A1 | 7/2011 | Otsubo | | |

FOREIGN PATENT DOCUMENTS

| | | |
|---|---|---|
| GB | 2177999 | 2/1987 |

* cited by examiner

*Primary Examiner* — Gwendolyn Baxter
(74) *Attorney, Agent, or Firm* — Myron Greenspan; Lackenbach Siegel LLP

(57) ABSTRACT

Universal Coaster and Stacking Device comprising two similarly shaped flat members spaced from each other in parallel planes and defining a central axis normal to the parallel planes forming a space between the flat members, which have similar configurations and peripheral edges and surfaces facing in axially opposing directions. Three parallel fingers are parallel to the central axis and positioned radially beyond the peripheral edges and axially beyond the outwardly facing surfaces. A linkage assembly is arranged within the space that has link portions extending beyond the flat member peripheries for supporting the fingers and for selectively moving the fingers between fully retracted positions for storage and supporting smaller vessels and fully extended positions for supporting larger vessels on the link portions when said fingers are brought into proximity with vessels in contact with the device.

20 Claims, 4 Drawing Sheets

UNIVERSAL COASTER AND STACKING DEVICE

BACKGROUND OF THE INVENTION

1. Field of the Invention

The invention generally relates to beverage vessel accessories and, more specifically, to a universal coaster/stacking device for cups, mugs and glasses.

2. Description of the Prior Art

Numerous devices have been proposed for stacking cups, mugs and other beverage vessels. Some of these devices serve as coasters as well as facilitate the stacking of mugs, cups, glasses, etc. to better organize a kitchen cabinet and secure the stacked vessels in a stable manner to avoid breakage.

UK Patent GB2177999 discloses a device described as a "stacking link" to allow the efficient and safe vertical stacking of containers such as casks, kegs and drums as illustrated in FIG. 2 of the patent. Another stacking aid is disclosed in U.S. Published Patent Application 20090057248 that discloses a device for supporting water bottles and vertically stacking one on top of the other as shown in FIGS. 3A and 3B. Contours of the support faces are configured to mate with the contours of a water bottle and a central opening is provided to receive the neck of a bottle. As such, the device can also be used to support a single bottle as shown in FIG. 2.

A device normally used to seal a container also includes opposite facing recesses for sealing an opening in the top of a container while securely receiving the closed bottom end of a container that can be stacked as shown in FIG. 1C. In U.S. Pat. No. 2,583,951 a cup and saucer shape or configuration is shown for facilitating the stacking of one cup above the other by using the saucer or plate as the aligning or retaining element. The device is also shaped or configured to receive a small cream jug on the saucer in a stable condition as shown in FIGS. 1 and 3.

U.S. Pat. No. 3,598,271, Japanese Patent 5,276,440, U.S. Published Applications 2011/0174658 and 2010/0133285 disclose specially designed or shaped container lids that are configured to allow multiple containers to be stacked one vertically above the other, serving the function of both sealing a lower container or cup and retaining the bottom end of an upper container or cup as shown, for example, in FIG. 7. With most of these designs the covers can also serve as a coaster for a single cup as shown in FIG. 2 of U.S. Pat. No. 3,598,271.

In some instances, cups and saucers have been specially designed and configurated to stack one upon the other. Examples are shown in U.S. Pat. No. 1,187,899 and U.S. Pat. No. 2,583,951.

Stacking devices have also been designed to accommodate specific cups, as suggested above, the devices being dimensioned to receive a container or vessel that has a specific size, dimension or configuration, as is the case with the devices disclosed in GB2,177,999 and U.S. Published Patent Application 2009/0057248. Some of the proposed devices could be used to accommodate a number of differently sized vessels by making them fixed sufficiently large to support both smaller and larger vessels. However, this would require a device that has a larger footprint and may be impractical for smaller vessels since that would result in the inefficient use of space within a kitchen cabinet. The prior art has not disclosed a universal coaster/stacking device that is easy and convenient to use and can make efficient use of space within a kitchen cabinet by being contractible or expandable to accommodate mugs, cups, glasses or the like of different sizes or shapes.

SUMMARY OF THE INVENTION

Accordingly, it is an object of the invention to provide a universal coaster/stacking device that is simple in construction and economical to manufacture.

It is another object of the invention to provide a device as in the previous object that is easy and convenient to use.

It is still another object of the invention to provide a device as in the previous object that optimizes the efficient use of cabinet space by adjusting its footprint to the size of the items to be supported or stacked;

It is yet another object of the invention to provide a device of the type under discussion that can be easily adjusted to accommodate both small and large beverage vessels.

It is a further object of the invention to provide a universal coaster/stacking device that can be readily collapsed for storage or shipment and expanded as needed when used.

It is still a further object of the invention to provide a device as in the previous objects that can serve both as a coaster for both cold and hot beverages and includes absorbing means for absorbing any condensation generated on the surfaces of cold beverage vessels.

In order to achieve the above objects, as well as others that will become evident hereinafter, a universal coaster/stacking device in accordance with the invention universal coaster and stacking device comprises two similarly shaped generally flat members spaced from each other in substantially parallel planes and defining a central axis generally normal to the parallel planes, and forming a space between the flat members, said flat members having similar configurations and peripheral edges and defining outwardly facing surfaces facing axially opposing directions. A plurality of fingers are provided oriented substantially parallel to said central axis and positioned radially beyond the peripheral edges and axially beyond the outwardly facing surfaces. An articulated linkage mechanism is arranged within the space and has at least link portions extending beyond the space and the flat member peripheries for supporting the plurality of fingers and for selectively moving the plurality of fingers between fully retracted positions for storage and supporting smaller vessels on the outwardly facing surfaces and fully extended positions for supporting larger vessels on the at least link portions when the plurality of fingers are brought into proximity with vessel portions in contact with the device.

BRIEF DESCRIPTION OF THE DRAWINGS

Those skilled in the art will appreciate the improvements and advantages that derive from the present invention upon reading the following detailed description, claims, and drawings, in which:

FIG. 9 is similar to FIG. 8 but also shows two stacked mugs or cups separated by the device shown in FIG. 8 to efficiently organize the cups within a cabinet or the like.

DESCRIPTION OF A PREFERRED EMBODIMENT

Figure 1:
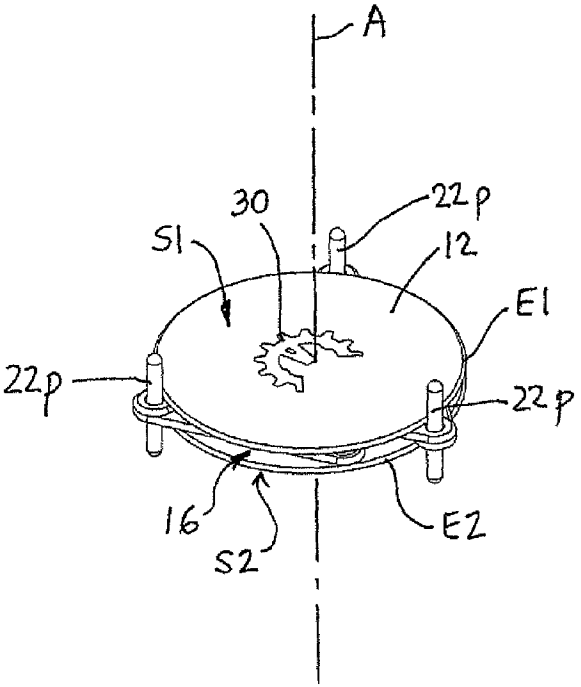
FIG. 1 is a perspective view of a universal coaster and stacking device in accordance with the invention, shown in its fully retracted condition.
Figure 2A:
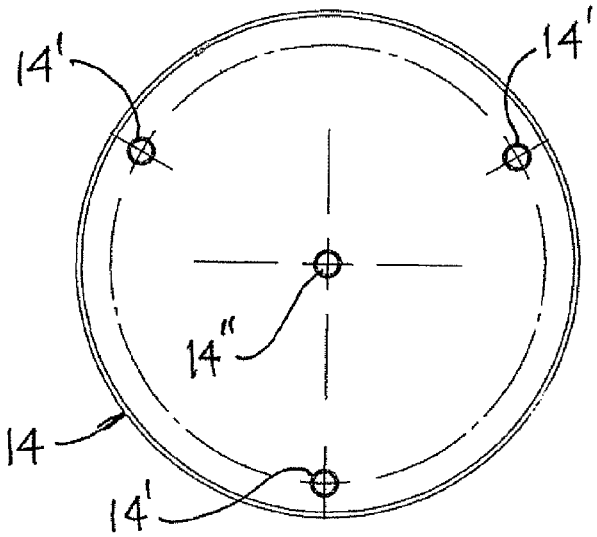
FIGS. 2*a* and 2*b* are top plan and side elevational views of one of the flat members of the device.
Figure 2B:
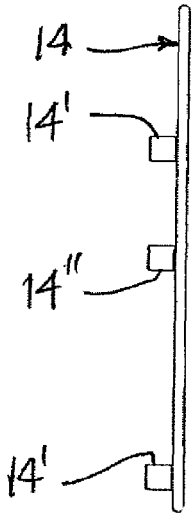
Figure 2C:
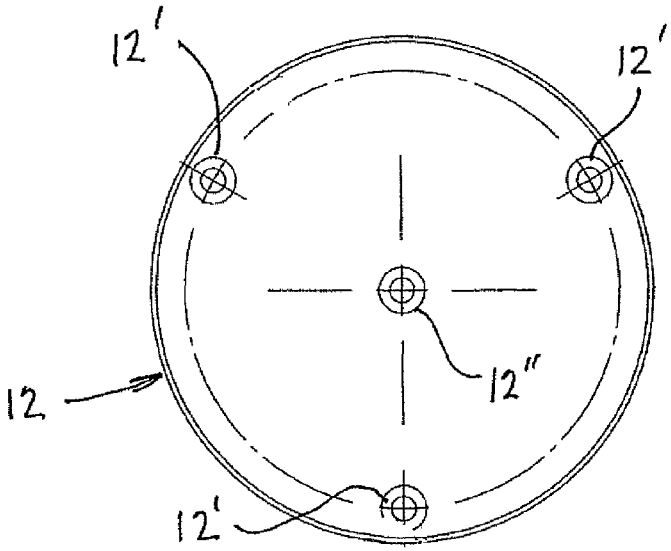
FIGS. 2*c* and 2*d* are bottom plan and side elevational views of the other opposing flat member.
Figure 2D:
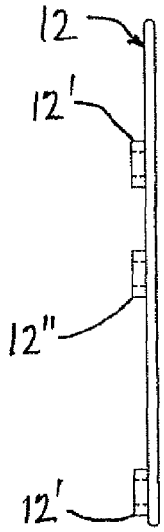

Referring now specifically to the Figures, in which the identical or similar parts are designated by the same reference numerals throughout, and first referring to FIG. 1, a universal coaster and stacking device in accordance with the invention is generally designated by the reference numeral 10.

The device 10 includes two similarly shaped, generally flat members 12, 14 spaced from each other and arranged in substantially parallel planes as shown. The flat members 12, 14 define a central axis A that is generally an axis of symmetry normal to the planes or members 12, 14 and form a space 16 between the flat members.

The flat members 12, 14 are of generally similar configurations and have peripheral edges E1, E2 and define outwardly facing surfaces S1, S2 facing axially opposing directions as shown. While the flat members can have numerous configurations they are shown in the preferred embodiment to be circular disks. It will be appreciated, however, that the flat members can assume different shapes, such as triangular, square or rectangular, octagonal, hexagonal etc.

Figure 2:
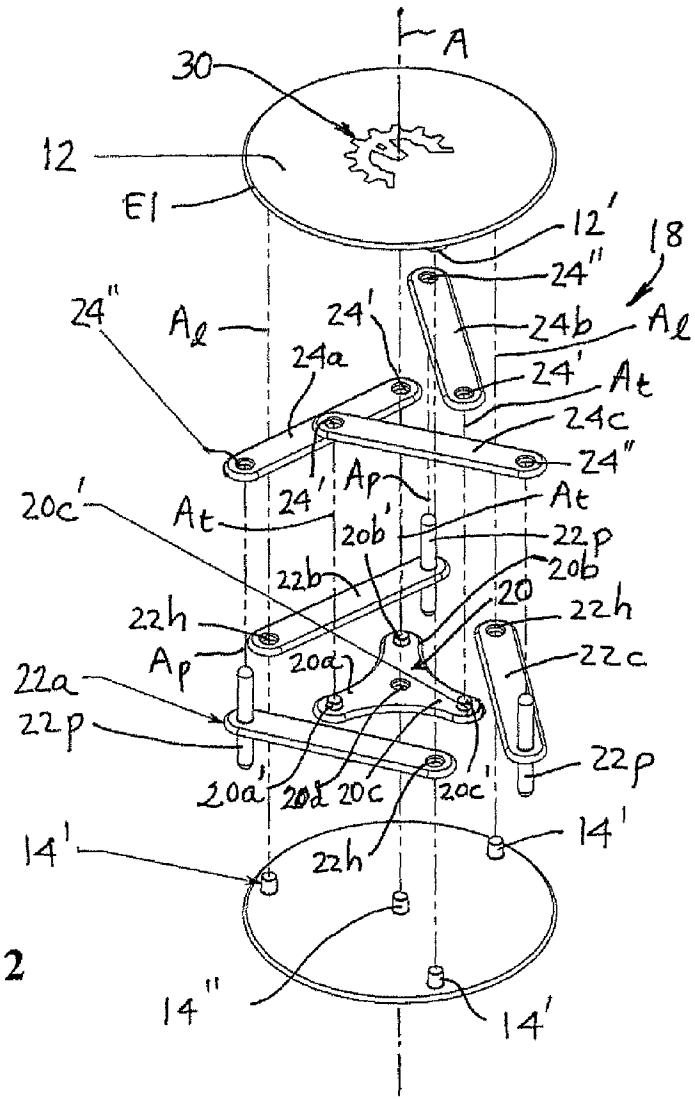
FIG. 2 is an exploded view, in perspective, of the device shown in FIG. 1.

Referring also to FIG. 2, a linkage assembly is generally designated by the reference numeral 18. Most of the linkage assembly is housed or arranged within the space 16 between the flat members 12, 14 as shown in FIG. 1.

While the flat members 12, 14 are generally the same, and are mirror images of each other, there are some differences, to be more fully discussed in connection with FIG. 2.

While it should be understood and appreciated that the device 10 is shown with the flat member 12 vertically above the flat member 14, as viewed in the figures, the device can easily be flipped 180° to place the flat member 14 above the flat member 12, with the same functionality, results and benefits. However, for purposes of the description that follows the flat member 12 will sometimes be designated as the upper or top flat member and the flat member 14 will be designated as the lower or bottom flat member, it being understood that this characterization is only used for purposes of explanation in relation to the drawings as they are shown. However, structurally and functionally, the flat members 12, 14 differ in that they may bear slightly modified bosses projecting into the space 16 on their inwardly facing surfaces to facilitate locking or joining the flat members 12, 14 to each other while serving as spacers to maintain the axial dimension of the space 14.

Linkage assembly 18 comprises a number of coupled linkages that cooperate with each other and have portions that are operatively connected or joined to the flat members 12, 14. Referring to FIGS. 2*a*-2*d*, the flat member 12 has downwardly projecting bosses 12' and a central boss 12" along the axis A, while the flat member 14 has upwardly projecting bosses 14' and a central boss 14" along the axis A. The boss 12" on the flat member 12 corresponds and cooperates with the boss 14". Aligned and cooperating bosses 12", 14" on the two flat members are designed to mate and lock after assembly. Thus, the bosses 12" can be sockets and the bosses 14" can be pins that can be press fit or secured with adhesive between mating portions or the like. In the embodiment shown, in FIG. 2, flat member 14 bears, on its inwardly facing surfaces three bosses 14' equally spaced from each other or angularly spaced 120° about the circumference or edge E2. The same number of downwardly depending bosses are provided on the inwardly facing surfaces of the flat members 12, 14. Such bosses 12', 12", 14' and 14" are arranged to be alignable for registration purposes.

The linkage assembly 18 includes a tri-arm 20 including three radial projections or sub-arms 20*a*, 20*b* and 20*c*. Upwardly projecting bosses 20*a*' 20*b*' and 20*c*' extend near the remote ends of each of the sub-arms 20*a*, 20*b* and 20*c* as shown. The tri-arm 20 also has a central aperture or hole 20*d*.

The linkage assembly 18 also includes three links 22*a*, 22*b* and 22*c* each of which is provided with a finger or pin 22*p* at one end and a hole 22*h* at the opposing or remote end. The linkage assembly 18 also includes three links 24*a*, 24*b* and 24*c* each of which has two apertures at their remote ends, designated by the reference numerals 24', 24" as shown.

Each of the pin-bearing links 22*a*, 22*b* and 22*c* are arranged so that their respective holes or openings 22*h* receive one of the projecting pins 12', 14' so that the ends are coupled to the pins 12', 14' although they are pivotally mounted on such pins or bosses. The links 24*a*-24*c* have one hole 24' that receives the bosses or projections 20*a*', 20*b*', 20*c*' while the opposing holes of these links 24*a*-24*c* receive one of the fingers or pins 22*p*. When assembled, the links 22*a*-22*c* and 24*a*-24*c* are all pivotally mounted in relation to either the bosses projecting from the flat members or on the bosses projecting from the tri-arm 20. Because these links are interconnected pivoting one of the links 22*a*-22*c* to move the pins 22*p* radially inwardly or outwardly causes all of the pins 22*p* to similarly move inwardly or outwardly without the need to adjust the orientation of each of the linkages when the links pivot about the axes A, $A_l$ and $A_p$. When the links are assembled, they all fit within the space 16. The links are pivotally movable but remain attached to the flat members 12, 14 by being attached to their inwardly projecting bosses.

The articulated link of the linkage assembly 18 form a means arranged within the space 16 and have at least portions (shown extending beyond the edges E1, E2) extending radially beyond the space 16 and the peripheral E1, E2 for supporting the fingers 22*p*. As suggested, therefore, the pins 22*p* can be selectively moved between fully retracted positions, as shown in FIG. 1, for storage or supporting smaller vessels, such as mugs, cups and glasses, and for also supporting larger vessels when fully extended to move the pins 22*p* within a range determined by the lengths of the links or linkage members 22*a*-22*c* and 24*a*-24*c*.

Figure 3:
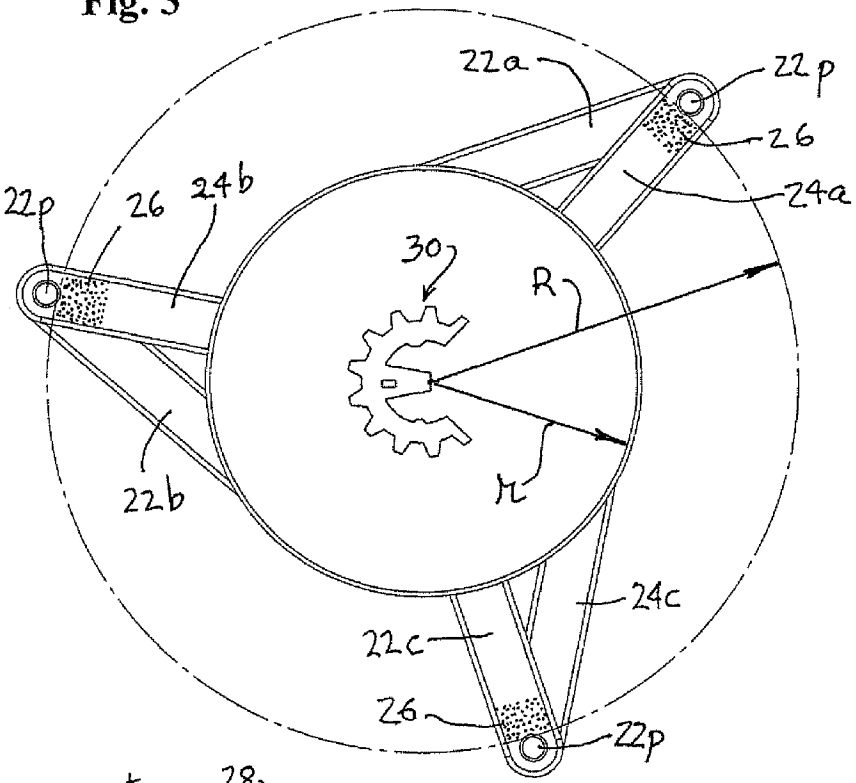
FIG. 3 is a top plan view of the device shown in FIG. 1, shown in its fully expanded or extended condition, and showing, in phantom outline, a large periphery of a vessel that can be in contact and supported by the device.
Figure 5:
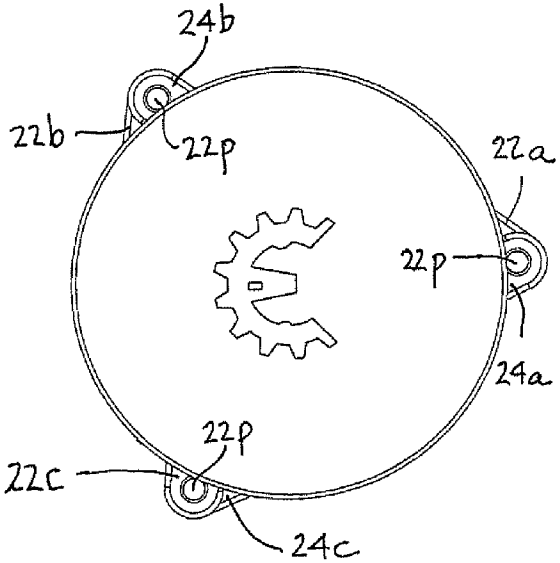
FIG. 5 is similar to FIG. 4 but shows the device in its fully contracted or retracted condition.
Figure 4:
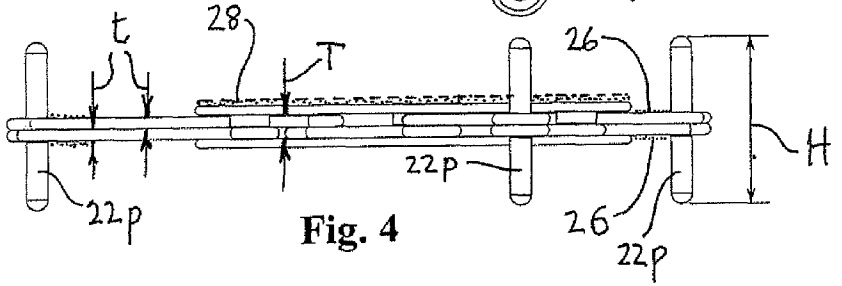
Figure 6:
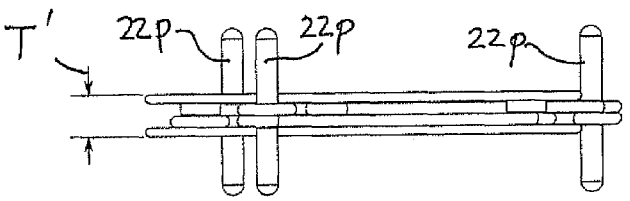
FIG. 6 is a side elevational view of the device shown in FIG. 5.

Referring to FIGS. 3 and 4, the condition of the links are shown in their fully expanded or extended condition wherein the fingers 22*p* are located at the outer maximum positions. FIGS. 5 and 6 show the same device with the pins 22*p* in their fully contracted or retracted positions when the links are almost fully collapsed within the space 16 and the pins 22*p* but against the peripheries E1, E2. When in the contracted or retracted condition of the linkage assembly the radius of the footprint occupied by the device is substantially equal to "r". However, for larger vessels, such as mugs or large cups, the device can be expanded by pulling the pins 22*p* radially outwardly thereby also extending the linkages 22*a*, 22*b* and 22*c* to their maximum exposed positions to form a support having a footprint of radius "R".

While the device can be made to satisfy any dimensional requirements, in the presently preferred embodiment the radius r is approximately 1.5"(diameter 3") while the radius R is equal to approximately 2.6"(diameter 5.1") in the fully extended condition.

Referring to FIGS. 4 and 6, axial height of the space 16 is "T" while the links 22*a*-22*c* and 24*a*-24*c* each have thicknesses of "t", T being approximately equal to twice the thickness t of the links but slightly larger to provide some clearance so that the links can freely move to selected positions without significant friction against the inner surfaces of the flat members 12, 14.

A feature of the invention is the provision of tacky or friction enhancing material 26 at least at the proximate the ends of each of the links 24*a*-24*c* to promote frictional contact between a vessel placed on the links 24*a*-24*c* to prevent relative movements or slippage between the vessel surface or edge of the vessel in contact with the links 24*a*-24*c*. This effectively provides a locking mechanism for preventing the pins 22*p* from inadvertently moving radially inwardly or outwardly when a vessel, such as a mug, cup or a glass is placed on the device 10 having a radius between r and R. Such material 26 can be any suitable tacky layer or substance and may be a thin sheet of rubber, a tacky sprayed coating, a tacky film or any other substance to provide a tacky surface on which a vessel sits on or engages.

According to another feature of the invention a liquid absorbing layer or pad 28 (FIG. 4) is provided on the upper surface of the flat member 12. The liquid absorbing layer is preferably placed on the upper flat member and has a diameter equal to approximately r to provide maximum absorbency of liquid or water that may condense on the exterior surface of a beverage vessel to minimize the degree to which such condensed water can drip on a surface on which the coaster or stacking device is placed. The absorbing layer 28 can be made of any suitable material, such as cork, sponge, or any other common material of which coasters are made. See, for example, U.S. Pat. No. 4,858,872 for a discussion of such absorbent pads or wicking elements. The liquid absorbing layer 28 may be either securely attached to the upper surface of the flat member 12, such as with adhesive, or may be an accessory to the device and placed on the upper surface 12 when cold beverages are being served.

Figure 7:
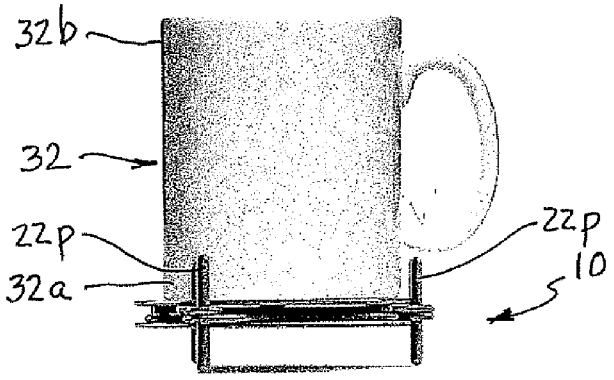
FIG. 7 is an illustration of the device shown when used as a coaster for supporting a cup or mug on the upper surface thereof.

Referring to FIG. 7, a cup 32 is illustrated being supported on the device 10 when it is used as a coaster. While the mug or cup 32 has a generally uniform cross section along its height many mugs, cups or glasses are tapered and have smaller dimensions at their bases and larger dimensions at the open mouths thereof. While the cup may be oriented with the base supported on the device 10 and the open mouth facing upwardly, the device 10 is primarily intended to be used so that the edge about the open mouth of the cup is supported either on the flat member 12, or the flat member 14 if the device is flipped 180°. Once the cup is placed on the device 10 the pins are pressed inwardly so that they come into contact with the side of the cup or, in the limiting case, against the edges E1, E2 for small vessels of the type shown in which case the cup rests directly on the upper surface S1 of the flat member 12.

Figure 8:
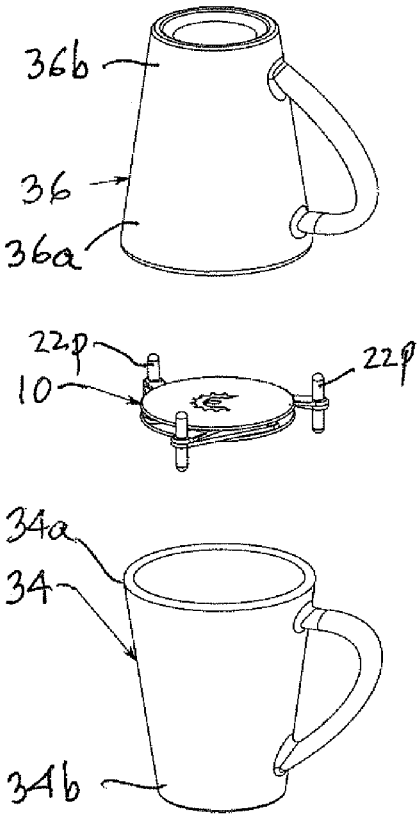
FIG. 8 shows the device about to be placed between two cups or mugs when used as a universal spacer and stacking device.
Figure 9:
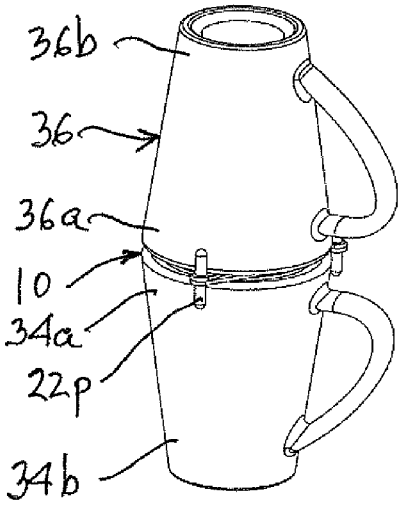

Referring to FIGS. 8 and 9, when the device 10 is to be used as a stacking member it is placed above the upper edge of the open mouth of a lower cup so that the circular edge abuts against either the lower surface of the lower flat member 14 or rests against the portions of the links proximate to the pins 22*p* when the pins are brought into abutment with the outer surface of the mugs, cups or glasses. Once the device is positioned as shown in FIG. 9, an upper, inverted cup or mug 36 can be placed on top of the device 10 with the open mouth facing downwardly and placed in contact with the device, each of the cups or mugs making contact with associated links ends. If the cabinet space is sufficiently high additional cups can be stacked and a further device 10 can be placed on top of the second cup and an additional or more cups can be supported by the lower cups. As long as each pair of stacked cups are separated by a device 10, cups can be stacked even if their peripheral diameters or dimensions are not identical. It will be appreciated, therefore, that the universal coaster and stacking device can quickly and easily be adapted or adjusted to accommodate vessels of different sizes or dimensions, including mugs, cups, glasses etc.

The device 10 can be made of any suitable materials. Such as metal, plastic, etc. Different materials can also be used for different parts of the device 10. For example, the flat members 12, 14 can be made of metal and the linkage assembly can be made of plastic or vice versa.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. Universal coaster and stacking device comprising two similarly shaped generally flat members spaced from each other in substantially parallel planes and defining a central axis generally normal to said parallel planes and forming a space between said flat members, said flat members having similar configurations and peripheral edges and defining outwardly facing surfaces facing axially opposing directions;

a plurality of fingers oriented substantially parallel to said central axis and positioned radially beyond said peripheral edges and axially beyond said outwardly facing surfaces; and articulated link means arranged within said space and having at least link portions extending beyond said space and said peripheries for supporting said plurality of fingers and for selectively moving said plurality of fingers between fully retracted positions for storage and supporting smaller vessels on said outwardly facing surfaces and fully extended positions for supporting larger vessels on said at least link portions when said plurality of fingers are brought into proximity with vessel portions in contact with the device.

2. A device as defined in claim 1, wherein the device is made of plastic.

3. A device as defined in claim 1, wherein said flat members are each circular discs.

4. A device as defined in claim 3, wherein said circular disc have a radius of approximately 3 inches.

5. A device as defined in claim 1, wherein three fingers are provided angularly spaced approximately 120° from each other about said central axis.

6. A device as defined in claim 1, wherein said articulated link means is arranged to move said fingers between a range of approximately 3 and 5.2 inches radius in relation to said central axis.

7. A device as defined in claim 1, wherein said articulated link means comprises a plurality of cooperating links.

8. A device as defined in claim 7, wherein said flat members form bosses projecting into said space and at least some of said links are pivotally connected to said bosses.

9. A device as defined in claim 7, wherein said flat members form a central boss along said central axis and further comprising a tri-arm pivotally mounted on said central boss.

10. A device as defined in claim 9, wherein said tri-arm has a boss projecting therefrom at each remote end of said tri-arm, at least some of said links being pivotaly coupled to said bosses on said tri-arm.

11. A device as defined in claim 1, wherein three fingers are provided that are integrally formed at one end of at least some of elongate links forming part of said articulated link means.

12. A device as defined in claim 7, wherein three of said plurality of links are elongate links and said fingers or pins are integrally formed at one remote end of each of said three links.

13. A device as defined in claim 12, wherein three additional elongate links are pivotably connected to said three links bearing said fingers or pins by receiving said fingers or pins through openings, holes or apertures within said additional links.

14. A device as defined in claim 13, wherein said link portions bear said fingers or pins and openings, holes or apertures of said additional elongate links.

15. A device as defined in claim 1, further comprising tacky or friction-enhancing means on said link portions.

16. A device as defined in claim 15, wherein said tacky or friction-enhancing means is applied to only a portion of said link portions radially inwardly of said fingers or pins.

17. A device as defined in claim 16, wherein said tacky or friction-enhancing means comprises a thin layer of material attached to said link portions.

18. A device as defined in claim 17, wherein said material is rubber.

19. A device as defined in claim 17, wherein said material is a tacky coating or film.

20. A device as defined in claim 1, further comprising a liquid-absorbing pad on at least one radially outwardly facing surface of said flat members for absorbing condensation that may drip from a vessel containing a cold beverage.

* * * * *